US008054236B2

(12) United States Patent
Martin

(10) Patent No.: US 8,054,236 B2
(45) Date of Patent: Nov. 8, 2011

(54) BROADBAND LOSSLESS DIPOLE ANTENNA

(75) Inventor: Torleif Martin, Linköping (SE)

(73) Assignee: Totalförsvarets Forskningsinstitut, Stockholm (SE)

( * ) Notice: Subject to any disclaimer, the term of this patent is extended or adjusted under 35 U.S.C. 154(b) by 335 days.

(21) Appl. No.: 11/921,452

(22) PCT Filed: May 18, 2006

(86) PCT No.: PCT/SE2006/000573

§ 371 (c)(1),
(2), (4) Date: May 4, 2010

(87) PCT Pub. No.: WO2006/130069

PCT Pub. Date: Dec. 7, 2006

(65) Prior Publication Data

US 2010/0220026 A1 Sep. 2, 2010

(30) Foreign Application Priority Data

Jun. 2, 2005 (SE) ..... 0501262

(51) Int. Cl.
*H01Q 9/16* (2006.01)

(52) U.S. Cl. ..... 343/792; 343/801

(58) Field of Classification Search ..... 343/790, 343/791, 792, 793, 807, 801
See application file for complete search history.

(56) References Cited

U.S. PATENT DOCUMENTS 3,000,008 A 9/1961 Pickles
3,703,812 A 11/1972 Newton
3,836,975 A 9/1974 Cassel
5,087,922 A 2/1992 Tang et al.
6,483,471 B1 * 11/2002 Petros ..... 343/725
6,642,902 B2 * 11/2003 Gustafson ..... 343/791
7,064,728 B1 * 6/2006 Lin et al. ..... 343/792
2004/0108962 A1 6/2004 Churng-Jou et al.

FOREIGN PATENT DOCUMENTS

DE 37 03 812 A1 8/1988
GB 515853 12/1939

OTHER PUBLICATIONS

Edward P. Tilton, "V.H.F. Antenna Facts and Fallacies: Part III—The How and Why of Matching Devices", QST, No. 3, Mar. 1964, pp. 29-34, XP001387898.

Alois Krischke, Rothammels Antennenbuch, 12th Edition, 2001, DARC Verlag, Baunatal, Section 10.3.4.1.

* cited by examiner

*Primary Examiner* — Hoanganh Le
(74) *Attorney, Agent, or Firm* — Jacobson Holman PLLC

(57) ABSTRACT

A lossless broadband dipole antenna of length L having three collinear parts including a central part and two external parts. The parts are separated by slits, with a first feeding point for the antenna being located at a first end of one of the external parts nearest the slits, and a second feeding point being located at a second end of the other external part nearest the slits. The two feeding points of the antenna at the slits are arranged at a distance d from each other along the length L of the antenna, d/L being chosen such that $$\frac{d}{L} = 0.37 \pm 0.04.$$

15 Claims, 3 Drawing Sheets

BROADBAND LOSSLESS DIPOLE ANTENNA

This is a national stage of International Application No. PCT/SE2006/000573 filed on May 18, 2006 and published in English.

BACKGROUND OF THE INVENTION

1. Field of the Invention

The present invention relates to a broadband lossless dipole antenna. The invention has been developed based on the requirements that exist in connection with broadband low-frequency radar, especially a type called CARABAS-II which uses the frequency range 20-90 MHz and requires an antenna with a relatively great beam width. In the following discussion, reference is made to this concrete example. How-ever, the antenna can also be used in other applications where a broadband antenna with a great beam width is desired and in other applications as well, and it is Applicant's pronounced opinion that the antenna should merit protection merely based on its construction and independently of its application.

2. Description of the Related Art

If a common dipole antenna should be used with the broadband low-frequency radar CARABAS-II, there will be problems with beam splitting at higher frequencies. FIG. 1 illustrates an example of a conventional dipole antenna with a central feeding point M, and FIG. 2 is an antenna gain chart for such a dipole antenna. The main beam, the central area with a high antenna gain, should essentially be constant over the frequency range. In the right part of the chart it is, however, to be seen that the problem with beam splitting starts to appear at about 75 MHz. A common dipole antenna thus is not suitable in the current case.

Up to now, CARABAS-II has used, instead of a common dipole, a dipole antenna in the form of a loaded slim biconical antenna, 4.9 m long. However, this antenna has an average efficiency over the frequency band of about 55% only, a higher efficiency being desirable. The reason for the low efficiency is that the antenna is provided with two filters, one on each dipole arm. The filters consist of parallel inductances, capacitances and resistances and are placed a distance onto the dipole arms. The filters prevent currents on the outer part of the dipole arms at higher frequencies, which prevents beam splitting occurring at the higher frequencies. A great part of the power supplied to the antenna is, however, absorbed in the resistances of the filters.

SUMMARY OF THE INVENTION

The present invention solves the problem of creating an antenna that does not have beam splitting, over a broad frequency band while at the same time functioning without filters and thus achieves 100% efficiency (if the metal structure is approximated as perfectly conductive). According to the invention, this is achieved by a lossless broadband dipole antenna, supplied at two feeding points, (M1, M2, S1, S2), which are symmetrically positioned along the length L of the antenna and at a distance d from each other such that $d/L=0.37\pm0.04$.

BRIEF DESCRIPTION OF THE DRAWINGS

The invention will now be described in more detail with reference to the accompanying drawings, in which.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
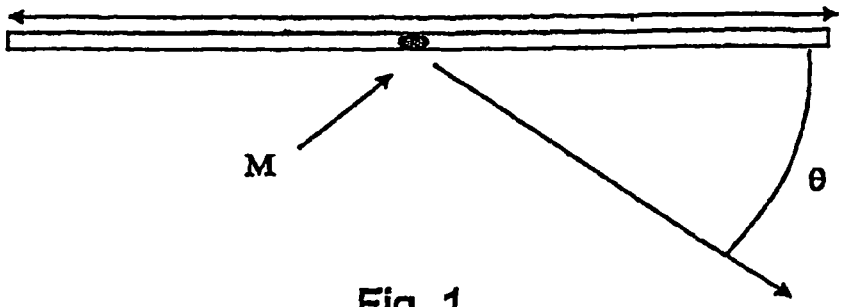
FIG. 1 shows an example of a conventional dipole antenna with a central feeding point M.
Figure 2:
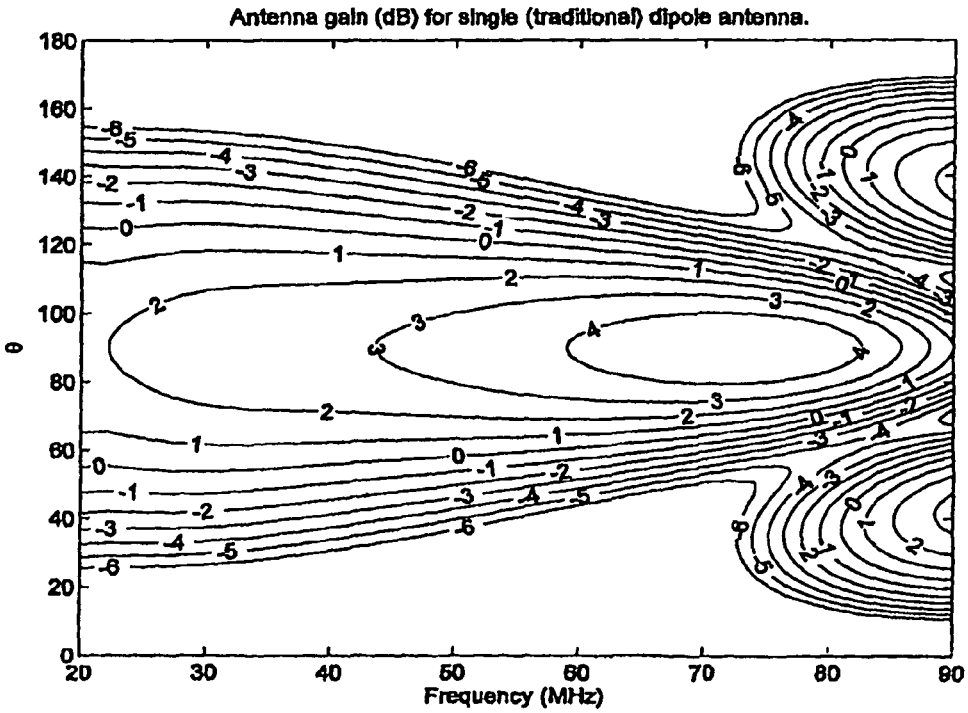
FIG. 2 is an antenna gain chart for the antenna in FIG. 1.
Figure 3:
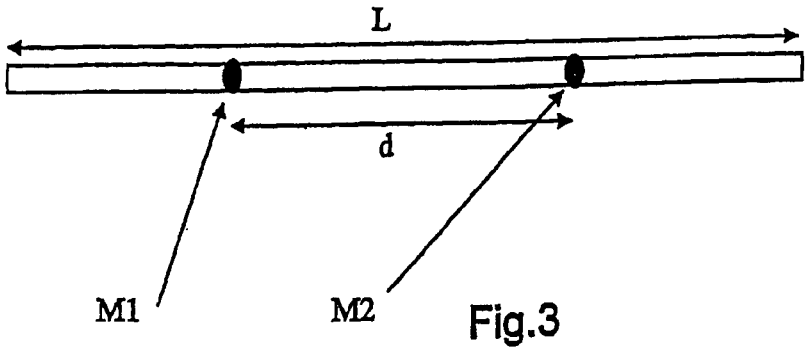
FIG. 3 is a basic sketch of an antenna according to the invention.

The basic concept of the invention involves feeding the antenna at two symmetrically positioned points M1 and M2 arranged at a certain distance from each other, see FIG. 3. The length L of the antenna, as well as the distance d between the feeding points, should according to the invention be in a certain relationship with the shortest wavelength $\lambda_{min}$ for which the antenna is intended. The antenna is a broadband antenna, and for a certain antenna length L, it is possible to calculate the longest wavelength $\lambda_{max}$ for which the antenna is suited. This will be developed in the following description.

Figure 4:
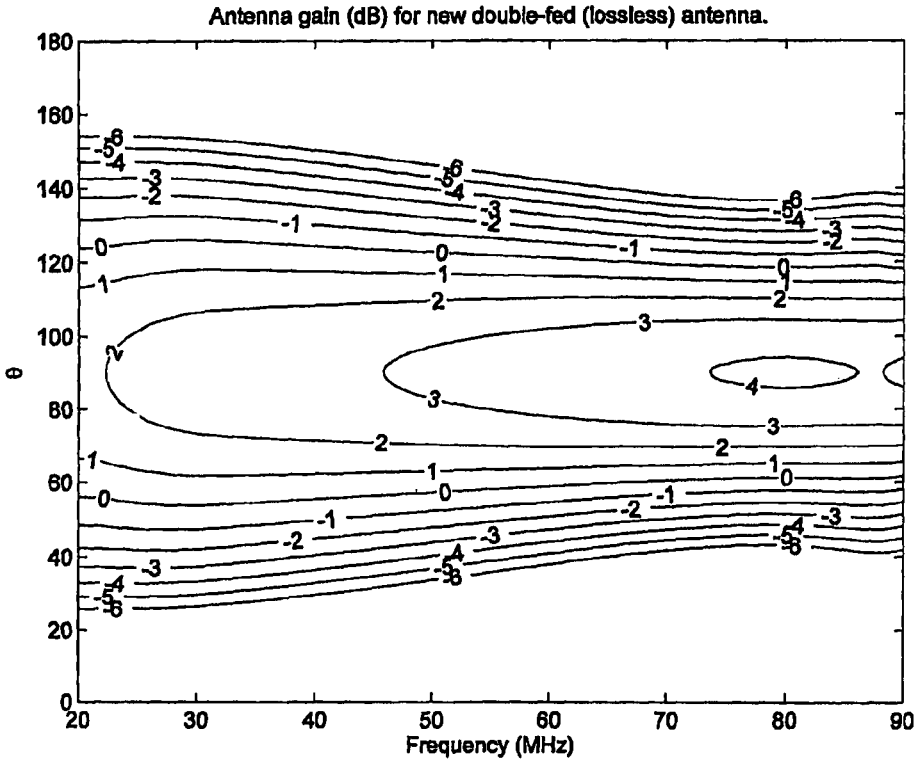
FIG. 4 is an antenna gain chart for the antenna in FIG. 3.

By feeding the antenna at two points according to the invention, the currents on the antenna which cause beam splitting are counteracted. There will be no losses for the antenna. FIG. 4 is an antenna gain chart for an antenna according to FIG. 3. The chart shows that there will be no beam splitting for the antenna in the desired frequency range. Since there are no loads, the efficiency of the antenna is 100% (if the metal structure is approximated as perfectly conductive).

The new dipole antenna is characterised in that it maintains a sufficient beam width over a broad frequency band. A sufficient beam width is defined as the antenna gain exceeding −1 dB within 90°±30°, that is between 60° and 120° in FIG. 3, while at the same time the antenna gain perpendicularly from the antenna (in the maximum direction) should exceed 2 dB over essentially the entire frequency band. The band width can be expressed without dimensions by relating the wavelength λ to the length L of the antenna. A traditional centrally supplied dipole satisfies the above requirements up to frequencies whose wavelength $\lambda_{min}$ is equal to the antenna length L, that is $L/\lambda_{min}=1.0$.

An antenna according to the invention satisfies the requirements for frequencies whose wavelength $\lambda_{min}$ is $L/\lambda_{min}=1.35$, which is great progress. At the same time the antenna can manage wavelengths up to $L/\lambda_{max}\sim0.3$, without the radiation resistance being too low and with an antenna gain in the main beam above 2 dB. As a result, the ratio of antenna length to wavelength may vary between $L/\lambda=0.3$-$1.35$.

This is achieved with the double-supplied dipole if the distance d between the feeding points satisfies the condition $d/\lambda_{min}=0.50\pm0.03$, where $\lambda_{min}$ is the wavelength at the highest frequency of the band. The double feeding cancels the variation of current which causes beam splitting for a common dipole. The antenna has acceptable properties as long as $d/\lambda_{min}=0.50\pm0.05$.

The distance between the two feeding points should, according to the discussion above, be in a certain relationship with the antenna length, $$\frac{d}{L} = 0.37 \pm 0.02.$$

As stated above, such an antenna functions excellently for wavelengths in the range $\lambda$=L/0.3-1.35. The antenna has acceptable properties as long as $$\frac{d}{L} = 0.37 \pm 0.04.$$

Figure 5:
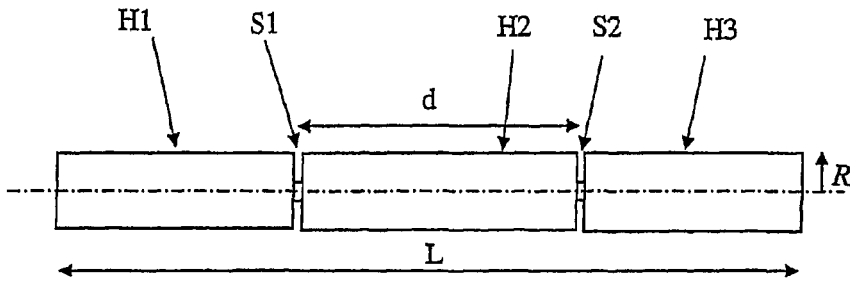
FIG. 5 is a sketch, not to scale, of an embodiment of an antenna according to the invention.
Figure 6:
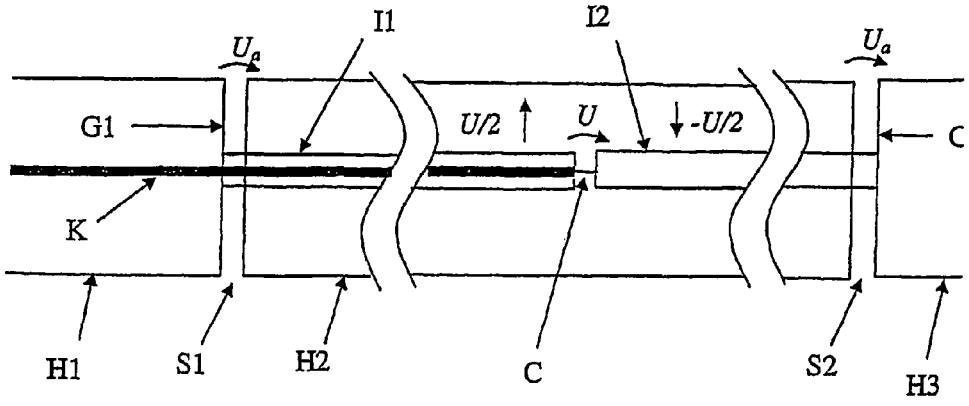
FIG. 6 shows enlarged parts of the antenna in FIG. 5, especially around two slits in the antenna.

FIGS. 5 and 6 illustrate more concretely an embodiment of the invention. As usual, the antenna has a conductive cover H1, H2 and H3, normally made of metal. In the exemplary embodiment, the cover is circular in cross-section, but may in other embodiments of the invention have a different cross-section. The radius R of the cross-section should be much smaller than the wavelength, $R/\lambda_{min}<<1$. In the example of an antenna for the frequency range 20-90 MHz that will be presented below and is shown in FIGS. 5 and 6, $R/\lambda_{min}\approx 0.03$, which corresponds to the radius R being 10 cm.

An advantageous way of feeding the antenna uses slits S1 and S2 which at the feeding points extend along the circumference of the antenna cover. The slits divide the antenna cover in the longitudinal direction into three parts, a central part H2 between the slits and an external part H1 and H3, respectively, outside the respective slits. Adjacent to the slits, the end of the external parts, which faces the centre, is covered with a conductive structure G1 and G2, which can be of different designs. In the exemplary embodiment, use is made of conductive end walls which cover the cross-section completely. In other cases, the conductive structures can be designed as radial spokes over the cross-section or in other ways. The antenna is supplied via these two end walls G1 and G2 by being in their centre each connected to an inner conductor I1 and I2 which extends along the central axis of the central part H2 of the antenna towards the centre of the antenna in the longitudinal direction, where the inner conductors practically meet, without contacting each other.

The inner conductors I1 and I2 are in the exemplary embodiment circular in cross-section with a constant radius, but may in other cases have a different cross-section and a varying radius. A varying radius can be used for the purpose of impedance matching. If the inner conductors have a constant radius and no other impedance matches are made, a suitable radius of the inner conductors is about 0.1 times the radius of the outer cover of the antenna, which in the CARABAS case means a radius of the inner conductors of about 1 cm.

The circumferential surface of the inner conductors is electrically shielding, either by the conductors having a closed conductive circumferential surface or, if they consist of a conductive mesh, by having sufficiently small meshes. An inner duct in one inner conductor I2 is used in the exemplary embodiment to hold the coaxial cable K which supplies the antenna, and by the inner conductors of the antenna having an electrically shielding circumferential surface, electric currents are prevented from occurring on the surface of the coaxial cable.

To prevent currents on the outer cover of the coaxial cable K outside the antenna, it is possible to design the coaxial cable in different ways with a choke/coil/inductance. For instance the coaxial cable can be wound on a ferrite core. The function of the antenna is not affected by this, but currents do not travel on the outer cover of the coaxial cable past the coil.

The antenna is supplied by the two inner conductors I1 and I2 at a central feeding point C being supplied from a coaxial cable K. One inner conductor I2 of the antenna is connected to the inner conductor of the coaxial cable K and the other inner conductor I1 of the antenna is connected to the outer conductor of the coaxial cable. The two inner conductors I1 and I2 of the antenna function as coaxial transmission lines together with the outer cover H2 on the central part of the antenna. The coaxial transmission lines are terminated with the slit openings S1 and S2 in the outer cover of the antenna, which are the actual radiation sources for the antenna. Half of the current U from the coaxial cable is distributed to each opening. It should be noted that the polarity in the right and the polarity in the left coaxial transmission line are opposite, which however causes voltage sources $U_a$ which are directed in the same way adjacent to the slit openings. No balun is necessary at the feeding point since the construction prevents currents from returning on the outer cover of the coaxial cable at its connection point in the centre of the antenna.

The slit width should typically be much smaller than the shortest wavelength $\lambda_{min}$. A suitable slit width is 0.005 to 0.010 times $\lambda_{min}$ which in the CARABAS case results in a slit width of about 2 cm. An upper limit where the function is impaired is a slit width of 0.1 times $\lambda_{min}$.

The lower limit of the slit width mainly depends on when the capacitance over the slit becomes so great that match problems and finally flashover occur. The antenna has the desired radiation properties until this occurs. A standard value, to provide an opinion where the lower limit of the slit width may be, is 0.001 times $\lambda_{min}$, which in the CARABAS case means about 2 mm. In practice, the lower slit width can be both below and above this standard value.

The antenna can in prior-art manner be provided with an impedance matching net-work which consists of reactive components. Impedance matching can occur either adjacent to the slit openings or at the feeding point in the centre of the antenna. In some embodiments of the invention, the inner conductors are cylindrical and have a radius which along its length is adjusted to the type of matching network that is used. An option is to use, as inner conductors I1 and I2, a conical conductive structure with a tip at the central feeding point C and a gradually increasing radius up to the conductive structures G1 and G2 adjacent to the slits S1 and S2. The antenna function described above is not affected by any impedance matching.

In a concrete antenna according to the invention, the cover, the end walls and the inner conductors can be made of aluminium or copper. To keep the inner conductor in the correct position, the inner conductors can be supported in the antenna cover by sheets of some dielectric material, for instance FRIGOLIT®. The coaxial cable can be of a common type for feeding antennas.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A lossless broadband dipole antenna of length L comprising three collinear parts, said parts including a central part and two external parts of substantially equal length, said parts being separated by slits, a first feeding point for said antenna being located at a first end of one of the external parts nearest the slits, and a second feeding point being located at a second end of the other external part nearest the slits, the two feeding points of the antenna at the slits being arranged at a distance d from each other along the length L of the antenna, d/L being chosen such that $$\frac{d}{L} = 0.37 \pm 0.04.$$

2. The dipole antenna as claimed in claim 1, wherein the feeding points are arranged at such a distance d from each other that $$\frac{d}{L} = 0.37 \pm 0.02.$$

3. The dipole antenna as claimed in claim 1, wherein the antenna includes a conductive cover, which is divided by said slits extending transversely to the longitudinal axis, along the circumference of the cover, into said three parts at the feeding points, the external parts, at their ends facing the slits, being provided with a conductive structure over their cross-sections, an inner conductor extending from each conductive structure along the central axis of the central part of the antenna substantially to a central feeding point of the antenna, without the inner conductors contacting each other, and the antenna at the central feeding point being fed by a coaxial cable the inner conductor of the coaxial cable being connected to one inner conductor of the antenna and the outer conductor of the coaxial cable being connected to the other inner conductor of the antenna.

4. The dipole antenna as claimed in claim 3, wherein the inner conductors have an electrically shielding circumferential surface and the coaxial cable (K) extends through one end of the antenna and runs in an inner duct in one inner conductor to the central feeding point.

5. The dipole antenna as claimed in claim 1, wherein the width of the slits is less than 0.1 times $\lambda_{min}$, where $\lambda_{min}$ is the shortest wavelength for which the antenna is intended.

6. The dipole antenna as claimed in claim 5, wherein the width of the slits is 0.005-0.010 times $\lambda_{min}$.

7. The dipole antenna as claimed in claim 3, wherein the cover of the antenna is circularly symmetric with a radius R selected according to $R \approx 0.03 \cdot \lambda_{min}$ where $\lambda_{min}$ is the shortest wavelength for which the antenna is intended.

8. The dipole antenna as claimed in claim 7, wherein the inner conductors have a circular cross-section with a constant radius amounting to about 0.1 times the radius R of the outer cover of the antenna.

9. The dipole antenna as claimed in claim 1, wherein a first conductor is connected at said first end of said one of the external parts nearest the slits, and a second conductor is connected at said second end of the other external part nearest the slits, said conductors feeding said antenna.

10. A lossless broadband dipole antenna, comprising two feeding points for said antenna which are symmetrically positioned along a length L of the antenna and at such a distance d from each other that, d/L=0.37±0.04 said antenna including a conductive cover which is divided by slits, extending transversely to a longitudinal axis, along the circumference of the cover, into three cylindrical parts at the feeding points, said parts including a central part and two external parts, said external parts, at their ends facing the slits, being provided with a conductive structure over their cross-sections, an inner conductor extending from each conductive structure along a central axis of the central part of the antenna substantially to a central feeding point of the antenna, without the inner conductors contacting each other, and the antenna at the central feeding point being fed by a coaxial cable, the inner conductor of the coaxial cable being connected to one inner conductor of the antenna and the outer conductor of the coaxial cable being connected to the other inner conductor of the antenna.

11. The dipole antenna as claimed in claim 10, wherein the inner conductors have an electrically shielding circumferential surface and the coaxial cable extends through one end of the antenna and runs in an inner duct in one inner conductor to the central feeding point.

12. The dipole antenna as claimed in claim 10, wherein the width of the slits is less than 0.1 times $\lambda_{min}$, where $\lambda_{min}$ is the shortest wavelength for which the antenna is intended.

13. The dipole antenna as claimed in claim 12, wherein the width of the slits is 0.005-0.010 times $\lambda_{min}$.

14. The dipole antenna as claimed in claim 10, wherein the cover of the antenna is circularly symmetric with a radius R selected according to $R \approx 0.03 \cdot \lambda_{min}$ where $\lambda_{min}$ is the shortest wavelength for which the antenna is intended.

15. The dipole antenna as claimed in claim 14, wherein the inner conductors have a circular cross-section with a constant radius amounting to about 0.1 times the radius R of the outer cover of the antenna.

* * * * *